United States Patent [19]

Mainwaring

[11] 4,396,396

[45] Aug. 2, 1983

[54] DEASHING OF COAL BY THE OIL AGGLOMERATION PROCESS

[76] Inventor: David E. Mainwaring, 1 Albert Rd., Melbourne, Victoria, Australia

[21] Appl. No.: 318,608

[22] Filed: Nov. 5, 1981

Related U.S. Application Data

[63] Continuation of Ser. No. 122,812, Feb. 20, 1980, abandoned.

[30] Foreign Application Priority Data

Feb. 23, 1979 [AU] Australia ..... PD7802

[51] Int. Cl.[3] ..... C01L 5/14; B09B 3/00; C10B 53/00

[52] U.S. Cl. ..... 44/24; 44/1 C; 44/15 A; 201/23; 241/20; 423/461

[58] Field of Search ..... 423/460, 461; 44/1 R, 44/1 A, 1 C, 15 A, 23, 24; 201/23, 24; 241/20

[56] References Cited

U.S. PATENT DOCUMENTS

| | | | |
|---|---|---|---|
| 1,420,165 | 6/1922 | Trent | 44/1 A |
| 3,148,140 | 9/1964 | Kaiser et al. | 423/461 |
| 3,637,464 | 1/1972 | Walsh et al. | 201/23 |
| 3,663,421 | 5/1972 | Parr | 201/23 |
| 3,957,456 | 5/1976 | Verseluur | 44/23 |
| 4,219,404 | 8/1980 | Dickakian | 208/44 |

FOREIGN PATENT DOCUMENTS

| | | | |
|---|---|---|---|
| 482459 | /0000 | Australia . | |
| 493570 | /0000 | Australia . | |
| 500065 | /0000 | Australia . | |
| 261594 | 11/1926 | United Kingdom | 44/1 A |

OTHER PUBLICATIONS

Murphy B. A., The Chemistry and Constitution of Asphalts Journal of the Institute of Petroleum, Dec. 1945, p. 475.

In Re Edwards 1956 CD 264, Apr. 18 1956.

*Primary Examiner*—Gary P. Straub

[57] ABSTRACT

A method of deashing coal wherein the coal is wetted with hydrocarbon liquid to form agglomerates and the hydrophilic agglomerates are then separated from a water and ash phase to yield deashed coal agglomerates. The hydrocarbon liquid is then recovered from the coal agglomerates by a vacuum stripping in the absence of oxidizing gases with or without use of super heated steam. Where super heated steam is used the removed hydrocarbon liquid is subsequently separated from the steam by cooling.

4 Claims, 2 Drawing Figures

DEASHING OF COAL BY THE OIL AGGLOMERATION PROCESS

Figure 1:
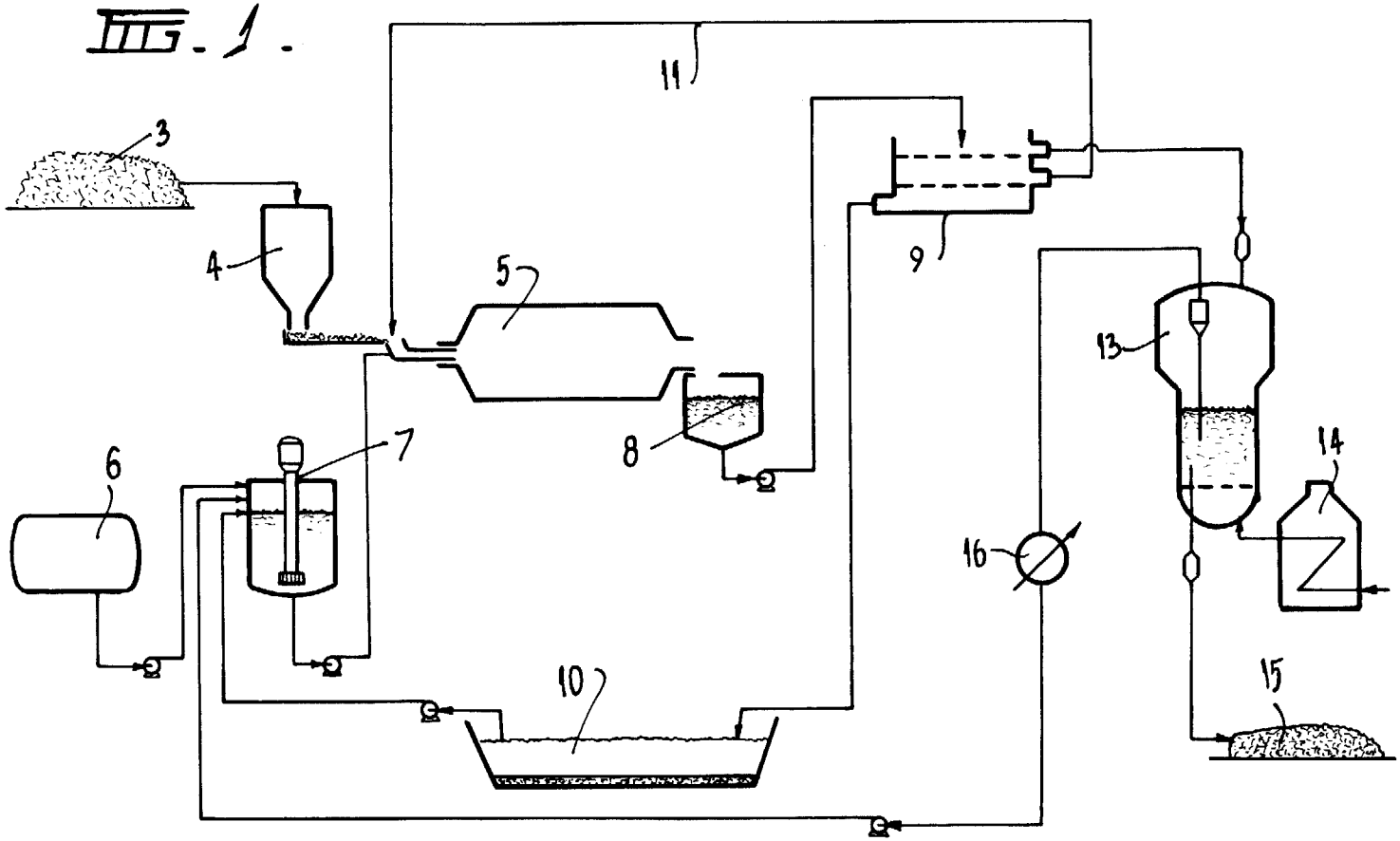

This is a continuation of application Ser. No. 06/122,812, filed Feb. 20, 1980 now abandoned.

PROCESS

This invention relates to a method of separating the carbonaceous content of coal from the mineral content and collecting it by the use of oil and more particularly this invention relates to a method of recovering the oil so used.

Agglomeration provides a method of collecting and retaining the finely divided carbonaceous part of an aqueous coal slurry into a size fraction and form which can be readily separated from both the water and ash. When the oil phase is introduced into a water slurry of finely ground coal it preferentially wets the carbonaceous coal fraction causing it to agglomerate as flocs. With various degrees of agitation and compaction these flocs form agglomerates and pellets. These can then be separated from the hydrophilic mineral matter which remains in the aqueous phase as a tailings fraction. The achievement of such agglomeration and separation has been described as occurring by many different techniques largely varying the types and combinations of size reduction, agitation and compaction These include the use of blenders and mills where both size reduction and agglomeration occur, recirculating pumps that yield largely agglomerates, and inclined pan and drum agglomerators, pelletizing separators and continuous contactors that yield agglomerates and spherical pellets.

Unlike conventional coal washing which centres around specific gravity differences to obtain a separation between mineral rich fractions and coal matter, agglomeration operates on preferential surface wetting. As such it is not limited in the same way by fines generation and recovery problems. The greater degree of size reduction that can be tolerated permits more extensive ash liberation to be accomplished. In instaces, oil agglomeration may replace conventional coal washing or some elements of it, serve as a supplementary process to coal washing, e.g. slimes reclamation, or as an independent coal handling process, e.g. coal slurry transport systems. More important is its potential to extend the range of coal processing capabilities by moving from the physical techniques of SG separation to those employing the surface chemistry of hydrocarbon-coal interactions (essentially a physical chemical processing).

The use of oil agglomeration to prepare coal by essentially fine grinding to enhance the release of inherent mineral matter is, as with coal washing, highly dependent upon the coal's ash liberation pattern—although dependent upon that pattern extended to a smaller size consist. The overall processing selectivity is a function of both the liberation of ash available to the aqueous mineral matter tailings fraction and the selectivity of the preferential wetting controlling the reporting to the hydrocarbon phase agglomerates or aqueous tailings.

Oil agglomeration involves not only agglomeration but size reduction, separation and compaction. Various processes that have been described before contain steps and combinations of steps that can be employed to achieve this. Advantages in mechanical and processing simplicity may result from such combinations as those detailed below:

STEPS

1. Size Reduction SZRN
2. Agglomeration AGGN
3. Separation SEPN
4. Compaction COMN where . . . represents an optional stage.

(a) A totally separated scheme is thus:

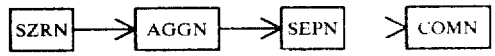

(b) Size reduction and agglomeration may be carried out in the same vessel—such as a colloid or rod mill:

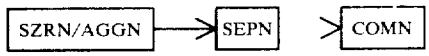

With separation on a vibratory screen optionally followed by further compaction by one of the typical methods—such as a balling disc.

(c) The rod mill particularly lends itself to the incorporation of a revolving separation screen that also closely parallels the behaviour of a conventional balling disc (as described later). This gives rise to the two combinations.

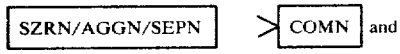

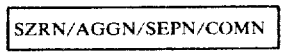

The last scheme indicates the possibility of a closely integrated system without a high degree of mechanical complexity that yields product that has undergone at least some compaction.

In achieving oil agglomeration one of the constraints upon the total coal recovered and the selectivity between coal and mineral matter is the total oil uptake in the formed agglomerate. This constraint of oil usage, which may largely be economical, can be minimized by agglomeration at the optimum oil uptake followed by partial oil phase recovery and recycle. In our approach disclosed here, an integrated scheme provides for the handling of a high throughput of a largely solid product and for a recovered oil phase product that is in a form suitable for recycle. In seeking the economic advantage of minimizing oil usage the value of the returned oil phase compensates for increased fixed operating costs and fuel consumption. Compaction of the agglomerates with little added processing cost, as above, decreases the void fraction available for initial oil uptake and thus the amount of oil requiring recycle.

Formation of agglomerates from a coal/water/hydrocarbon system follows definable stages in which the fundamental requirements for the design of agglomeration equipment may be recognised.

(i) In the absence of agitation the addition of oil to a coal/water suspension results in the formation of loose floc. The oil is absorbed onto the coal surface and the particles then begin to aggregate as collisions between oil coated particles results in their remaining loosely bound together (ii) Gentle agitation of the system in (i) results in more rapid and extensive floc formation but the aggregates remain loosely bound in gel-like formations.

(iii) Vigorous agitation results in the formation of more compact particles as collisions between the floc formations and the action of turbulence on the floc formations themselves ejects the aqueous phase from the internal floc structure and increases the number of paticle/particle interactions leading to binding.

(iv) Vigorous agitation of a system having a high particle, i.e. agglomerate, density results in the growth of larger particles by break-up and surface layer incorporation of the material of smaller particles. If carried on sufficiently this results in the production of even sized pellets from agglomerates.

For these reasons, form a design point of view, then, agglomeration equipment should provide conditions of high turbulance, and high particle hold-up to maximise interparticle collisions, although efficient formation of compact agglomerates has been achieved here in dense and dilute systems. Consideration of the method of introduction of coal, water and hydrocarbon to the agglomeration equipment should be made with a view to aiding the process mechanisms occurring within the equipment. A fine dispersion of oil in the aqueous phase prior to entry would aid the efficiency of hydrocarbon transfer to the coal surface i.e. for a given amount of agitation it is clearly more favourable to introduce hydrocarbon to a coal/water system as a hydrocarbon/-water emulsion, although agglomeration is clearly not dependent upon prior formation of an emulsion.

Binder requirements indicated in the literature show satisfactory agglomerate formation when 40–80% of the agglomerate void space is taken up by binder material. Compaction reduces the void space and lowers the relative binder requirement. Indications are that 9–15% by weight binder in the agglomerated material is a figure that can be achieved without sophisticated equipment or the use of highly specific hydrocarbon and surface active chemicals. Further, it would appear from the literature that the chemistry of the particle surface and its importance in the selection of optimal binder hydrocarbons has been neglected in favour of producing a mechanically effective agglomeration that is capable of using binders which are common oil products.

Separation of the agglomerate from the mineral content is the next phase of the process.

Agglomerate product is readily separated from the water and ash on a screen. The screen used may be (i) static, preferably inclined (ii) vibratory, as in the Sweco separator where a vibratory screen is used the possibility of obtaining pellet growth and associated further compaction should this be sought as an intermediate product.

Compaction and separation may be achieved in a rod mill by operating with a dual chamber system in which internal modifications to the second chamber would lead to (i) separation of the water and ash on a conical rotating screen, the pelletizing mechanism of which is very similar to a balling disc and for compaction only by making modifications such that (ii) the second chamber forms an agitation chamber designed to achieve pellitization with a high pellet hold-up.

Agglomerates, water and ash pass from the agglomeration/milling compartment to the compaction/-separation compartment via a screen in the discharge cylinder that passes agglomerate sized particles but prohibits reflux of the larger pellets to the mill.

The agglomerate particles are then taken up by the larger pellets forming the hold-up mass and in the nucleasion of new pellets. Pellet growth is shown in the literature to occur by:

(i) sticking together under impact of similarly sized particles (ii) break-up of small particles by larger ones, the material of the broken smaller pellets being taken up at a surface layer (or part thereof) of the larger particle.

It would seem reasonable that if a circulating hold-up of pellets could be maintained in the compaction/separation compartment, then agglomerates entering the chamber would be taken up by both mechanisms.

Discharge of the water and ash to the chamber below the cone occurs via a screen forming the innermost end of the cone that would pass neither pellets nor agglomerates and from there to a conventional peripheral/or grate discharge.

A suitable flow diagram for the process of the present invention is shown in the sheet of drawings.

As can be seen, following separation of the agglomerates the oil phase must be separated from the coal particles in order to maintain the process economically viable over a wide range of applications.

Prior art processes have either disregarded oil recovery or have used detergent washing of the coal to achieve some degree of oil removal.

The present invention provides a simple and efficient means of oil recovery. To this end the present invention provides a method of removing hydrocarbon liquids from carbonaceous solid material with which its mixed, in which the carbonaceous material/hydrocarbon mixture is subjected to vapour phase separation of the hydrocarbon content in the absence of oxidizing gases.

Two vapour phase separation methods which can be used in the present invention are:

(i) Vacuum stripping (ii) steam stripping either alone in the absence of air or in the presence of an inert gas. Both must be carried out in the absence of oxidizing gases to avoid oxidation of the carbonaceous material.

The steam stripping process may include the following variations:

(a) steam stripping including vacuum steam stripping (b) mechanical arrangements: fluidized beds, draft tubes, fluidized solids conveying systems (c) methods of heat input: superheated steam as the preferred method, internal heating coils, and preheated solids which can be separated from the agglomerate pellets such as ceramic spheres.

The process of this invention of removing the oil component in the vapour phase has advantages over other methods of oil recovery such as further mechanical compaction or dissolution/dipersion in aqueous media using surfactants. The present invention particularly when steam stripping is used does not degrade the oil phase. There is no necessity to remove surfactants which would inhibit the recovered oil's surface active properties—particularly if recycled.

Steam stripping provides one method of heat transfer to the agglomerates. Where high heat loads arise from increased hydrocarbon and water in the agglomerates, supply of heat via a circulating solid heat carrier in conjunction with steam is the preferred method for fluid bed steam stripping. The heat required can be contained in the superheated steam. The fluidized bed used in the examples provides for rapid heat and mass transfer with a lowering of the necessary residence times. The rates of removal in our steam stripping process are considerably higher than can be achieved in a liquid aqueous medium with surfactants.

Steam stripping recovers the oil phase in a highly controlled manner to achieve the desired degree of oil removal. Examples show that oil can be quantitatively removed and recovered to fractions of one per centum left on the product. Steam stripping in the vapour phase employing insert superheated dry steam disengages the oil from the coal agglomerates rapidly and provides a clean separation. Condensation then provides an efficient method of recovering the oil phase together with the water in a form which is immediately ready for recycle and reuse. The addition of small make-up quantities are the only requirement. This has great advantages over the recovery of hydrocarbon vapours from non-condensable stripping gas streams such as intert gases. High degrees of recovery of the valuable oil product require for example sub-ambient cooling to retrieve low concentrations in such streams. This described process employing steam stripping extracts the oil phase to a high degree and then by a simple steam/-vapour condensation recovers the hydrocarbon ready for make-up and recycle.

The process described here for the recovery and recycle of the oil phase in coal-oil agglomeration improves the economics of any coal cleaning or recovery process employing agglomeration by utilizing a low grade heat source such as high ash steaming coal to recover the higher value oil component of the agglomerates. Coal of minimal value such as oxidized and high ash coal prevalent about mine and washery sites, can be utilized and improves the overall economies of coal mining.

By achieving coal oil agglomeration with a blend of oil components this process of steam stripping permits the recovery of a selected component only (usually the lighter one) and allows the others to remain as binder hardeners in the agglomerate pellet product. For example, a light kerosene or diesel oil can be added to heavy fuel oil to decrease its viscosity and aid agglomeration selectivity. The higher value light oil can be steam stripped out and condensed ready for re-addition to further heavy fuel oil while the lower value fuel oil is left in the agglomerates as a pellet hardness enhancer.

The process disclosed here has the advantage that is yields a product dried to a predetermined degree unlike for example an aqueous surfactant system. Hence no secondary drying to a suitable usable standard is required.

The recovery and recycle process not only improves the economics of agglomeration systems but has two significant improvements in the technical operation of selective oil agglomeration. Firstly, the selectivity and partition coefficient for the selective recovery of clean coal can be optimized by utilizing high value oil components to form the agglomerates. Since the bulk of the oil remains recycled within the process, oils of greater selectivity and recovery can be employed. Secondly, coal recovery via agglomeration can be optimized with a greater usage of the oil component during the agglomeration recovery stage since it is then stripped back for recycle with little added cost in steam and heat usage. Hence the economic constraints on oil usage and composition are alleviated by this disclosed process for the recovery and recycle of the oil component. In fact a direct trade off between the extra amount lower value steam coal used and the increased selective recovery of higher value clean coking coal is made possible.

A very important advantage of this invention for the recovery and recycle of the oil component of coal-oil agglomerates is the inert blanketed atmosphere provided by the dry steam. This process causes no deterioration in the coal's properties particularly for coking coals. The coking properties—particularly swelling—are susceptible to degredation by surface oxidation. It has been shown that the products from this process form a strong dense coke, maintain their swelling number and maintain or improve their coking properties. This advantage may also be significant for coal conversion coals whereby instead of the coking properties being maintained the reactivity and conversion yield are maintained by blanketing effect of the stripping steam.

Although the strength of the agglomerate pellet is not diminished by the steam stripping process trace abrasion does occur in the fluidized bed. This is minimized by the short residence time required in the fluidized steam stripper due to the rapid heat and mass transfer rates, and further minimized if desired by the inclusion of hardness enhancers as outlined above. This disclosed process also has the advantage that any coal fines generated by attrition are carried with the steam and oil phase and recovered with them where they are recycled for re-agglomeration.

The preferred method of vapour phase oil removal—steam stripping at atmospheric pressure has advantages in decreasing the complexity of plant required for vacuum removal of the oil phase. Not only is the vessel simpler but sealing of feed and exit systems is simplified.

The heating of the coal agglomerates that is permitted by the blanketing action of the dry steam environment not only prevents oxidation and possible deterioration of the coal's properties but allows for heat induced hardening of the stripped agglomerate product. For example, this can be arranged by two routes—-firstly, the oil phase left behind can interact with the coal substance under mild heating which induces binding, secondly, chemical additives present during agglomeration may induce cross-linkage and binding.

This invention permits optimization of the agglomeration method of recovering high value coals such as coking and conversion coals without the economic constraints on the type and amount of oil required. It permits the recovery of a higher value resource-oil by utilizing lower grade high ash steaming coal without contamination and degradation of the higher value coal product. The recovery of the disengaged oil phase is accomplished by sweeping the hydrocarbon phase out during condensation providing an efficient method of oil recovery without the need for sophisticated chemical plant. The condensed steam and oil is recovered in such a form that it is directly ready for re-use requiring only 'make-up' additions prior to recycle.

These two stripping methods are independent of the agglomerate forming process and as such provide a route by which an economical hydrocarbon usage may be achieved if this is not possible in the agglomerate forming process alone. Both rely on the vapour pressure-temperature characteristic for the binding hydrocarbon and on the mechanism by which the binding hydrocarbon in the agglomerate is transferred into the vapour phase.

Use of either process involves increasing the temperature of the binder hydrocarbon in the agglomerates to achieve satisfactory transfer rates. Transfer of hydrocarbon from the agglomerates would take place through the surface layer of the agglomerate particles. Production of an environment of uniform temperature, high particle/vapour contact and short contact time would thus be looked to, to provide uniform de-oiling and minimumize energy wastage through bulk heating of the agglomerate particle. That is, conditions in which the ratio of heat energy transferred to the binder hydrocarbon to heat energy transferred to coal in the agglomerate is maximized since bulk heat energy is essentially lost with the agglomerate product stream.

Such conditions are aided by a fluid-bed steam stripper whereas these are more difficult to produce in a vacuum stripping unit. Vacuum stripping has the inherent problems of higher capital cost and operating difficulty and in this case where heat transfer to a particulate solid is required, it has the disadvantage of becoming a more mechanically oriented system producing a less homogeneous de-oiling environment.

The present invention also provides a process of deashing coal which comprises crushing mined coal into small sized particles, subjecting said coal to wetting with a hydrocarbon liquid and forming agglomerates of carbonaceous material in said coal, separating said carbonaceous agglomerates from non carbonaceous material present in said coal, subjecting said carbonaceous agglomerates to vapour separation treatment in the absence of oxidizing gases to separate the hydrocarbon liquid from said carbonaceous material to produce the deashed coal product and recycling said hydrocarbon liquid for use in wetting said mined coal.

FIG. 1 of the drawings shows a schematic outline of the method of this invention. Raw coal as shown at 3 is fed from hopper 4 into the rod mill 5. A water oil emulsion is also fed to the rod mills from the emulsification unit 7. After treatment in the rod mills 5 the slurry passes to a collection tank 8 and is subsequently passed to the separating screen unit 9. In the unit 9 the water and ash phase is passed through the screens and fed to the settling tanks 10. Coal fines which have not agglomerated are returned via the line 11 to the rod mills. The agglomerated coal product is passed into the hydrocarbon recovery unit 13 wherein steam from generator 14 is passed through a fluidized bed of the agglomerates. This enables separation of the hydrocarbon from the coal product 15. The hydrocarbon is recycled through the condenser 16 to the emulsification unit 7. Additional hydrocarbon, to replace losses, is added to the emulsification unit from the storage 6.

Figure 2:
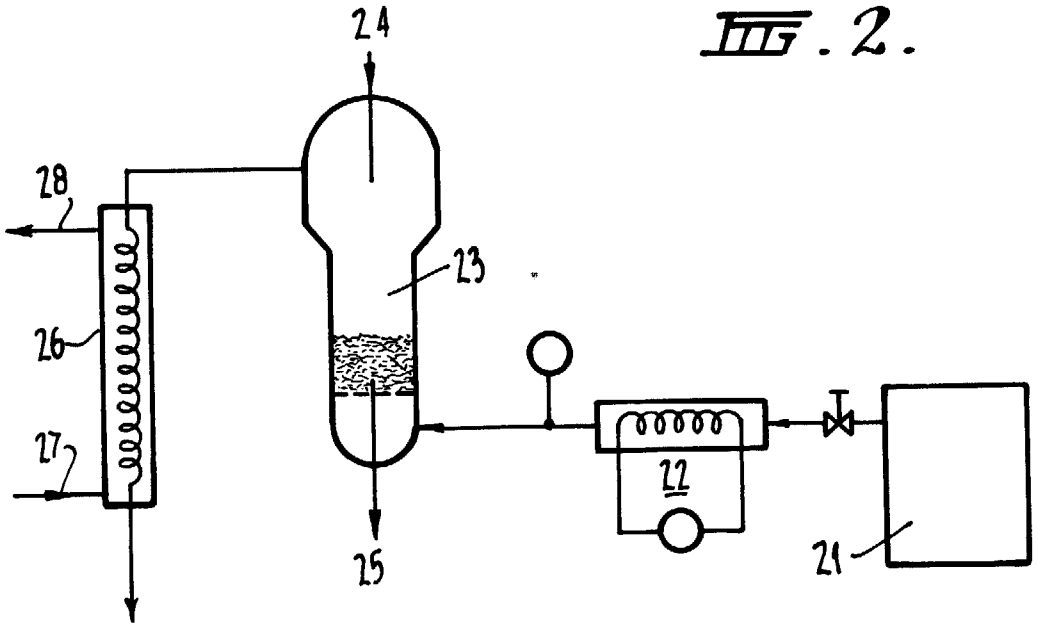

FIG. 2 shows in more detail the hydrocarbon separation flow arrangement. The steam for the stripper is generated in coal fired generator 21 and passed through the super heater 22 to the base of the fluidized bed stripping unit 23. The dry steam flows up through the stripping unit to fluidize the coal agglomerates which are fed into the stripper 23 as indicated by the line 24. The agglomerates can be fed batchwise or continuously. Stripped coal agglomerates are removed via line 25. The oil and steam are removed from the top of the unit 23 and passed through the condenser 26. The condenser 26 is cooled by water entering by inlet 27 and leaving by outlet 28. The cooled water and hydrocarbon phases are then easily separable.

The lump coal fed to the mill is dependent in general on its source and is constrained only by the efficiency of the rod/ball mill agglomerator in the case where size reduction and agglomeration occur simultaneously. This ranges from ROM coal having undergone one stage of primary grinding to typical fines recovered from a coal washery.

Degree of size reduction is dictated by an observed loss in agglomerate strength, above 150μ particles and the lower limit set by the degree of fine grinding required for ash liberation. This is dictated by the distribution of the ash in the original coal.

The overall range of feed and product sizes can be expressed as approximate topsizes of 4" and 50μ respectively. The preferred range (though highly dependent on the particular coal) can be expressed as approximately −1" and −80μ respectively.

The residence time necessary for agglomeration and ash separation has been observed to be relatively short. The preferred range of agglomerating time is 0.5–2.0 minutes. When agglomeration and size reduction are carried out simultaneously the agglomeration time is well within the time necessary for sufficient size reduction. The necessary times for size reduction generally fall within the range 10–30 minutes.

The oil content of the separated agglomerates preferably falls in the range 10–30 wt % tab and more preferably 15–22 wt %. Selection of the oil is largely governed by minimising losses in the mechanical handling of agglomerates due to vapourisation and the energy required for oil recovery. Preferred oils lie in the range from diesel to light cycle and fuel oils.

Sizes of agglomerated product preferably fall in the range 1–6 mm and more preferably 2–4 mm either as mill formed platelets or pipeline formed spheres.

The water content of the agglomerate product is preferably in the range 6–12 wt % tab and more preferably 6–8 wt % tab. Water content is a significant factor in oil recovery heat loads and as such is sought to be minimised.

There will now be described illustrative examples indicating one preferred mode of carrying out the present invention.

FEEDCOAL

A medium volatile bituminous feed coal was selected to provide a coal of high total ash with a large proportion of highly dispersed inherent ash of extremely small particle size. Such a coal when conventionally washed typically yields a low recovery of clean coal.

A sample of run-of-mine coal (1 tonne) was prepared to a 6 mm top particle size by successive passes of the oversize material through roll crushers. The total crushed material was reconstituted to yield a representative sample of the total run-of-mine material.

Analysis of a representative sub-sample:

| PROXIMATE | | ULTIMATE | |
|---|---|---|---|
| Moisture % | 0.8 | Carbon % | 84.2 |
| Ash | 28.0 | Hydrogen | 5.11 |
| V.M. | 23.9 | Nitrogen | 1.77 |
| F.C. | 47.3 | Sulphur | 0.65 |
| | | Oxygen | 8.27 |
| | | Carbonates | 0.58 |

The central equipment used (CPR) is an 18" diameter 4'6" long rod mill designed to process a whole crushed coal feed at rates between 2 kg/hr and 500 kg/hr. A grinding medium charge of fifty to one hundred 1" diameter steel bars may be used with mill speeds between 18 and 45 r.p.m. The mill is fully rubber lined and is serviced by an emulsion generation and liquid feed system, solid feed system and a product separation system.

Coal is moved in this pilot facility pneumatically with nitrogen from the sample drums to the storage hopper. There it is maintained under a nitrogen atmosphere until it is fed into the plant.

Experimental runs have been performed with ROM seam coal having an ash content of 28%. The coal as fed to the mill have a 6 mm top size, 80% passing size of 4.5 and 30% passing size of 1.2 mm. Ash tests on the feed coal show the ash size distribution to have an 80% passing size of 1.2 mm and a 30% passing size of 38μ. Ash originating from adventitious matter in the ROM coal appear to be present in the crushed feed coal as +300μ particles and represents 46.4% by weight of the total ash present. The remaining 53.6% of the −300μ ash represents the finely dispersed inherent ash component of the coal. Ash levels found in various size fractions of the feed range from 50.3% in the +3.35 mm fractions through 35.9% for −3.35 mm+1.70 mm, 25.2% for −1.70 mm+850μ to a consistent 20% for fractions down to −38μ. The inherent ash level for the feed appears to be around 14.8%.

With respect to oil phase composition, agglomeration of ground coal has utilized in this example a highly parafinnic hydrocarbon, BP Solvent 78, as the binding hydrocarbon which has the composition.

| | |
|---|---|
| Boiling Range 200-288° C. | |
| Aromatics | 20% |
| Olefins | 5% |
| Paraffins/Naphthenes | 75% |
| Sulphur | 0.2% |
| S.G. | 0.79 |
| Viscosity | 15 ctsks |

Generation of low mineral matter content agglomerates 8.0 wt % (dcb) in this example requires particle size reduction of the feed coal before or during agglomeration to 80 wt % passing 32 and 30 wt % passing 4.

The potential for recovery of the oil phase from the agglomerated product of the Coal-oil Agglomeration plant by the mechanism of fluid bed steam stripping is shown in the following illustrative examples.

A continuous steam stripping rig with a maximum solids throughput of 5 kg/hr was utilized in these examples. Saturated steam generated at 100 psig passes through a pressure reducing valve dropping the pressure into the 0-4 psig range. The steam then passes into a superheater consisting of a tube containing a heating oil and enters the fluid bed stripper at approximately 1 to 3 psig and 100° to 225° C. In fluidizing a bed of approximately 100 gm of agglomerates, the steam strips the binder into the vapour phase and passes through a water cooled condenser. Condensate collected from the condenser recovers the oil and water as separate liquid phases. Feed to the bed is via a hopper and oscillating plunger. Stripped product is removed by overflow into a central standpipe level with the surface of the bed and fitted with an oscillating plunger similar to the feed unit. Control of the bed temperature is achieved by controlling the degree of superheat in the fluidizing steam. A thermocouple in the bed is used as reference for a power controller in the superheat coil circuit. Bed temperatures utilized in these examples fall in the range 110°-160° C.

Initial batch experiments were carried out to estimate the required residence times, fluidization velocities and response of the bed to load changes. Constant rate stripping periods of 3.5 mins. and 4.5 mins. were obtained for 70 gm and 110 gm beds, suggesting this order of time would be required for stripping at 100° C. Rapid introduction of wet agglomerates to the dry bed at 150° C. showed that an instantaneous 20% or less replacement of the bed did not lead to significant depression of the bed temperature.

Steam pressures of 1.25 psig and 2.5 psig below the distributor plate gave satisfactory fluidization of 70 gm and 310 gm beds respectively. These figures correspond to superficial fluidizing velocities of 41-63 cm/sec. Fluidization characteristics are highly dependent on agglomerate size and higher velocities may be necessary to fluidize larger agglomerates. The relative pressure drops in the stripper were determined as approximately 1 psig drop across the distributor plate and 0.2 psig/cm in the fluidized agglomerates.

Residual kerosene levels and kerosene recoveries are shown in Table 1. From a feed of approximately 15 wt% (tab) kerosene, and 15 wt% (tab) water, a product of not more than 1.0 wt% tab kerosene and 2.5-3.0 wt% tab water was obtained.

Data obtained for continuous operation on the same feed material at a feed rate of 18 gm/min. for a residence time of 10 min. and stable bed temperature of 130° C. is presented in Table 2. Product was obtained at 0.46-1.00 wt% (tab) kerosene and 1.61-2.61 (tab) wt% water. This run suggested feed rate limitations and later runs in smaller beds (approximately 50 gm) showed similar analyses at residence times less than 2.0 minutes.

Continuous operation for a feed rate of 20 gm/min. to a 60 gm bed at a stable temperature of 100° C. with a residence time of 5.2 mins. yielded product at 0.58-0.78 wt% (tab) kerosene, 2.30-3.23 wt% (tab) water. Both of the above runs were of approximately 20 min. duration and terminated on exhaustion of the prepared feed lot.

Continuous runs FBS 3-8 examine the dependence of the residual kerosene content of stripped agglomerates on bed temperature and residence time. Operating conditions for each run are presented in Table 3 and span the ranges 120°-150° C., 0.65-1.97 min.

Feed agglomerates produced specifically for these six runs analysed at an average 19.34 wt% (tab) kerosene and 5.3 wt% (tab) water. Table 4 indicates the spread of values over the samples of CPR 12 agglomerates analysed. The feed rate of wet agglomerates to the bed in each experiment was approximately 30 gm/min. Each run processed approximately 800 gm of feed material in approximately 25 minutes. The minimum steam usage for this feed composition is about 1 kg of steam for 10 kg of feed.

Samples taken during these runs comprised the total product of consecutive two minute intervals, i.e. approximately 45 gm dry coal per sample. These were then subjected to analysis.

Values of residual kerosene levels in dry agglomerate product and arithmetic mean bed temperature in the sampling interval are presented in Table 5 to 7, and range from 2.05 wt% tab kerosene at 130° C. to 0.22% at 145° C.

The caking and swelling behaviour of the stripped product was checked and found not to have deteriorated. This is illustrated by comparing the swelling number of 7 obtained from the stripped agglomerate product with that of 7 to 7.5 obtained from clean washed coal samples from the same coal seam.

Analysis of data from runs FBS 1–8 has shown that recovery of kerosene from low ash coal agglomerates by fluid bed steam stripping may be achieved at residual kerosene levels between 0.5 and 2.0 wt% tab, temperatures between 110° and 160° C., and residence times of 0.5 to 2.0 minutes.

The composition range for products obtained both by agglomeration and oil recovery for this particular coal is summarized in Table 8.

Subsequent experimentation is a continuous fluid bed steam stripper having a maximum solids throughput of 100 kg/hr. has confirmed the stated data for platelet type agglomerates.

Data obtained for spherical agglomerates indicates that for agglomerates in the size range 1–6 mm and preferably 2–4 mm removal of diesel oil to 0.5–2.0 wt % (total agglomerate basis) can be achieved at temperatures between 130° and 180° C. for residence times of 3–6 minutes using superficial fluidizing velocities of 1.0–2.0 m/sec. Feed compositions are in the range 8–12 wt % and 10–30 wt % tab diesel oil.

TABLE 1

RESIDUAL KEROSENE LEVELS & RECOVERIES

| Run and Sample No. | Residual Kerosene (wt % tab) | Residual Water (wt % tab) |
|---|---|---|
| FBS 1.1 | 1.0 | approx. 2.0 |
| 1.2 | 1.0 | approx. 1.0 |
| 1.4 | trace | approx. 1.0 |
| 1.5 | trace | approx. 1.0 |
| 1.6 | coking test sample | |

TABLE 2

STRIPPED PRODUCT ANALYSIS

| Run and Sample Number | Kerosene and (wt % tab) | Kerosene (wt % tab) | Water (wt % tab) |
|---|---|---|---|
| FBS 1.7.1 | 34.34 | 14.54 | 19.80 |
| 1.7.2 | 2.33 | 0.72 | 1.61 |
| 1.7.3 | 13.06 | 0.59 | 12.46 |
| 1.7.4 | 2.86 | 0.70 | 2.11 |
| 1.7.5 | 2.36 | 0.69 | 1.64 |
| 1.7.6 | 3.65 | 1.00 | 2.61 |
| 1.7.7 | 2.88 | 0.46 | 2.40 |

NOTE:
FBS 1.7.1 represents the feed material
FBS 1.7.3 is a water contaminated sample where tab.

TABLE 3

RUN OPERATING CONDITIONS FBS 3–8

| Run | Nominal Bed Temperature (°C.) | Residence Time (min.) | Fluidizing Steam Pressure (psig) |
|---|---|---|---|
| FBS 3 | 135 | 1.06 | 3.1 |
| 4 | 150 | 0.65 | 3.2 |
| 5 | 145 | 1.62 | 3.2 |
| 6 | 150 | 1.42 | 3.4 |
| 7 | 140 | 1.66 | 3.3 |
| 8 | 120 | 1.97 | 3.2 |

TABLE 4

FEED SAMPLE ANALYSIS CPR 12 AGGLOMERATES

| Sample Number | Kerosene and water (wt % tab) | Kerosene (wt % tab) | Water (wt % tab) |
|---|---|---|---|
| CPR 12.1 | 21.6 | 20.48 | 1.1 |
| 12.2 | 24.2 | 20.14 | 4.1 |
| 12.3 | 28.8 | 18.55 | 10.2 |
| 12.4 | 24.8 | 18.38 | 6.4 |
| 12.5 | 23.5 | 19.15 | 4.7 |

TABLE 4-continued

FEED SAMPLE ANALYSIS CPR 12 AGGLOMERATES

| Sample Number | Kerosene and water (wt % tab) | Kerosene (wt % tab) | Water (wt % tab) |
|---|---|---|---|
| Mean | 24.6 | 19.34 | 5.3 |

TABLE 5

BED TEMPERATURE vs RESIDUAL KEROSENE
FBS - 3 and 4

| Run and Sample Numbers | Bed Temp (°C.) | Residual Kerosene (wt % tab) | Run Number | Bed Temp. (°C.) | Residual Kerosene (wt % tab) |
|---|---|---|---|---|---|
| FBS 3.1 | 148 | 0.98 | FBS 4.1 | 159 | 1.37 |
| 3.2 | 144 | 1.20 | 4.2 | 155 | 1.90 |
| 3.3 | 151 | 0.80 | 4.3 | 145 | 2.23 |
| 3.4 | 137 | 1.01 | 4.4 | 162 | 1.20 |
| 3.5 | 131 | 1.80 | 4.5 | 148 | 2.89 |
| 3.6 | 146 | 0.59 | 4.6 | 145 | 2.32 |
| 3.7 | 136 | 1.00 | 4.7 | 146 | 2.38 |
| 3.8 | 130 | 2.05 | 4.8 | 150 | 1.65 |
| 3.9 | 128 | 0.30 | 4.9 | 143 | 1.93 |
| 3.10 | 122 | 1.70 | 4.10 | 143 | 2.36 |
| 3.11 | 130 | 1.90 | 4.11 | 145 | 3.84 |
| 3.12/13 | 131 | 2.01 | 4.12 | 147 | 2.64 |
| 3.14 | 133 | 1.84 | 4.13 | 150 | 3.11 |
| 3.15 | 146 | 1.40 | 4.14 | 150 | 3.12 |
| | | | 4.15 | 143 | 3.20 |
| | | | 4.16 | 145 | 2.67 |

TABLE 6

TEMPERATURE vs RESIDUAL KEROSENE
FBS - 5 and 6

| Run and Sample Numbers | Bed Temp. (°C.) | Residual Kerosene (wt % tab) | Fun and Sample Numbers | Bed Temp. (°C.) | Residual Kerosene (wt % tab) |
|---|---|---|---|---|---|
| FBS 5.1 | 165 | 0.59 | FEB 6.1 | 152 | 0.51 |
| 5.2 | 156 | 0.38 | 6.2 | 152 | 1.00 |
| 5.3 | 150 | 0.83 | 6.3 | 149 | 0.92 |
| 5.4 | 148 | 0.77 | 6.4 | 160 | 0.64 |
| 5.5 | 145 | 0.59 | 6.5 | 157 | 0.71 |
| 5.6 | 150 | 0.68 | 6.6 | 152 | 0.97 |
| 5.7 | 146 | 0.79 | 6.7 | 145 | 1.09 |
| 5.8 | 146 | 0.91 | 6.8 | 149 | 0.83 |
| 5.9 | 145 | 0.98 | 6.9 | 139 | 1.23 |
| 5.10 | 145 | 0.86 | 6.10 | 148 | 0.66 |
| 5.11 | 130 | 1.17 | 6.11 | 142 | 1.05 |
| 5.12 | 141 | 1.02 | 6.12 | 141 | 1.11 |
| 5.13 | 150 | 0.67 | | | |

TABLE 7

BED TEMPERATURE vs RESIDUAL KEROSENE
FBS - 7 and 8

| Run and Sample Numbers | Bed Temp. (°C.) | Residual Kerosene (wt % tab) | Run and Sample Numbers | Bed Temp. (°C.) | Residual Kerosene (wt % tab) |
|---|---|---|---|---|---|
| FBS 7.1 | 138 | 1.01 | FBS 8.1 | 120 | 0.57 |
| 7.2 | 132 | 0.80 | 8.2 | 115 | 0.85 |
| 7.3 | 132 | 0.85 | 8.3 | 120 | 0.87 |
| 7.4 | 130 | 0.92 | 8.4 | 127 | 0.85 |
| 7.5 | 132 | 1.08 | 8.5 | 119 | 0.82 |
| 7.6 | 140 | 0.62 | 8.6 | 128 | 0.44 |
| 7.7 | 140 | 0.89 | 8.7 | 120 | 0.78 |
| 7.8 | 136 | 0.78 | 8.8 | 126 | 0.90 |
| 7.9 | 136 | 0.84 | 8.9 | 131 | 0.45 |
| 7.10 | 135 | 0.77 | 8.10 | 120 | 1.15 |
| 7.11 | 137 | 1.08 | 8.11 | 119 | 1.28 |
| 7.12 | 141 | 0.62 | 8.12 | 123 | 0.63 |
| 7.13 | 145 | 0.22 | 8.13 | 119 | 1.06 |

TABLE 8

| COMPOSITION RANGE OF PRODUCTS | | | |
|---|---|---|---|
| Feed Coal: | | ROM 27.5% Ash | |
| Coal Recovery in Product: | | 97 + % | |
| | Ash (deb) | Kerosine | Water |
| Plant | 9.5–10.5% | 11.0–16.0% | 13.0–15.0% |
| Batch | 8.0–10.5% | 11.0–16.0% | 30.0–40.0% |
| Agglomerates Total Composition | | | |
| | Ash Free Coal | Ash | Kerosine | Water |
| Plant | 61.8–68.8% | 6.6–8.0% | 11.0–16.0% | 13.0–15.0% |
| Batch | 61.8–69.9% | 5.5–8.0% | 11.0–16.0% | 13.0–15.0% |
| Stripped Agglomerates Total Composition Basis | | | |
| | Ash Free Coal | Ash | Kerosine & Water |
| Plant | 87.7–89.9% | 9.3–10.5% | 0.6–2.1% |
| Batch | 87.7–91.4% | 7.8–10.5% | 0.6–2.1% |

The claims defining the invention are as follows:

1. A process for producing abrasion-resistant coal agglomerates of reduced non-carbonaceous content from non-carbonaceous-material-containing coal which comprises crushing mined coal and fine grinding the coal to a top particle size of about 150 microns, while contacting the coal with an emulsion of a hydrocarbon liquid agglomerating agent and water so as to preferentially wet the coal particles with the hydrocarbon liquid, while the non-carbonaceous material, being hydrophylic, is dispersed in the water, and forming agglomerates of carbonaceous material in said coal in said grinding zone and in the presence of raw coal being ground, said agglomerates having an average pore space between coal particles such as to allow the oil content of the agglomerates to measure less than about 30 weight percent, separating said carbonaceous agglomerates from said non-carbonaceous material present in said coal along with the water in which it is dispersed, subsequently suspending said carbonaceous agglomerates as a fluidized bed in a stream of dry steam in the absence of oxidizing gases at a temperature in the range of about 100° C. to about 245° C. to separate at least a portion of the agglomerating agent from said carbonaceous material to produce the deashed coal agglomerate product; and withdrawing the steam/hydrocarbon mix from said fluidized bed, condensing said mix and recovering the recycling the agglomerating agent.

2. The process of claim 1 in which the top particle size to which the coal is fine ground is about 80 microns.

3. A process as claimed in claim 1 wherein the agglomerating agent comprises a mixture of a light and a heavy oil fraction such that only the light oil fraction is removed during the steam treatment of the agglomerates.

4. The process of claim 1 or claim 3 in which a high-ash containing coal is used as the feed material, and the ash content of the product material has been reduced by at least about 17 percentage points (the reduction being calculated as weight percent ash in feed coal minus weight percent ash in product).

* * * * *